US005542551A

United States Patent [19]

Smith

[11] Patent Number: 5,542,551

[45] Date of Patent: Aug. 6, 1996

[54] DISPLAY STAND WITH REINFORCED BOTTOM SHELF

[75] Inventor: Jerrold A. Smith, Plainview, N.Y.

[73] Assignee: Arrow Art Finishers, Inc., New York, N.Y.

[21] Appl. No.: 339,951

[22] Filed: Nov. 15, 1994

[51] Int. Cl.[6] ..... A47F 5/00

[52] U.S. Cl. ..... 211/50; 211/132; 248/174

[58] Field of Search ..... 211/132, 72, 73, 211/50, 149; 248/174

[56] References Cited

U.S. PATENT DOCUMENTS

| | | | |
|---|---|---|---|
| 2,391,285 | 12/1945 | Williamson et al. | 211/73 X |
| 3,721,413 | 3/1973 | Robinson | 248/174 |
| 4,570,805 | 2/1986 | Smith | 248/174 |
| 4,579,232 | 4/1986 | Fedak | 211/132 X |
| 4,723,664 | 2/1988 | Smith | 248/174 X |
| 4,947,996 | 8/1990 | Harris | 211/132 X |
| 4,962,859 | 10/1990 | Kump | 248/174 X |
| 5,083,663 | 1/1992 | Conway et al. | 211/50 X |
| 5,094,349 | 3/1992 | DeVito | 211/88 X |
| 5,277,388 | 1/1994 | Denaro | 248/174 X |
| 5,301,800 | 4/1994 | Kenney | 248/174 X |

*Primary Examiner*—Robert W. Gibson, Jr.
*Attorney, Agent, or Firm*—Kirschstein et al.

[57] ABSTRACT

An erectable display stand includes a generally planar back panel, a generally planar shelf for supporting objects, and at least one generally planar supporting wall. The shelf and the supporting wall are connected to the back panel for movement relative thereto between their collapsed positions in which they extend in substantial parallelism with one another and with the back panel in close proximity of the latter, and an erected position in which they extend substantially normal to the back panel and parallel to each other in large-area surface-to-surface contact with one another for the supporting wall to support the shelf from below when the stand is in use. The supporting wall may have a rearward extension that transfers the area of ground contact to behind the stand proper, so that the latter may assume a rearwardly tilted attitude when in use.

15 Claims, 6 Drawing Sheets

FIG.8
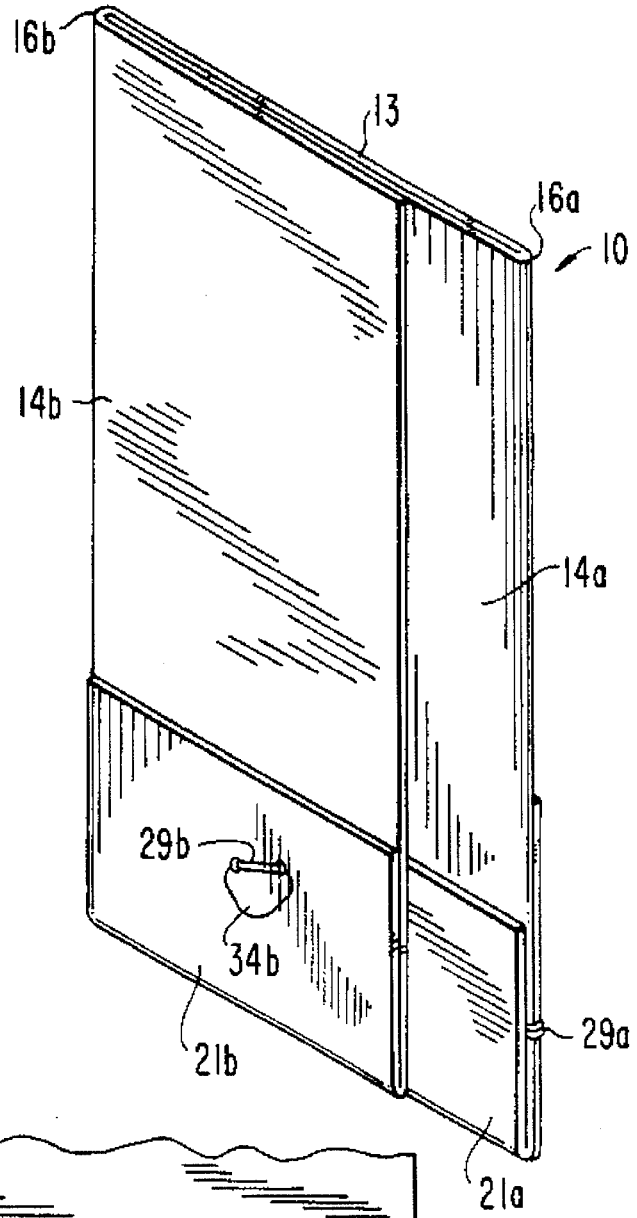
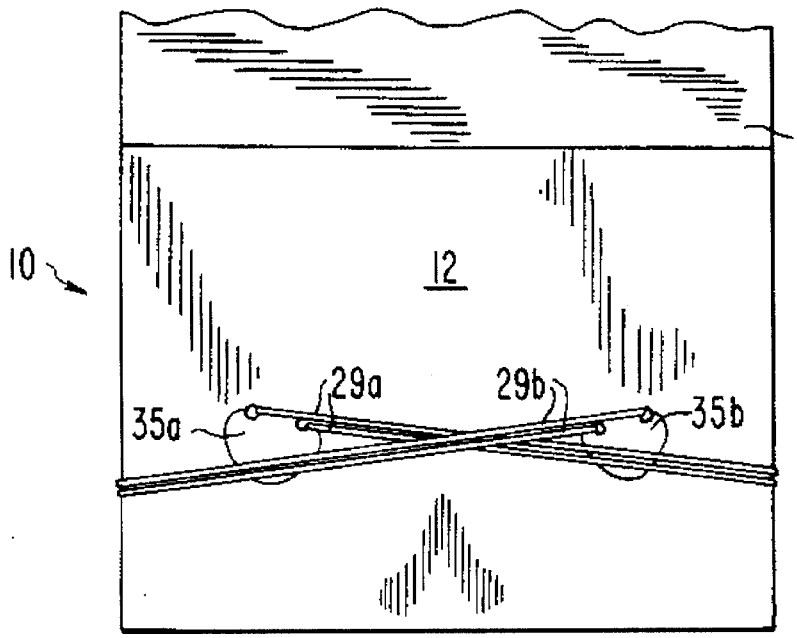
FIG.9

DISPLAY STAND WITH REINFORCED BOTTOM SHELF

BACKGROUND OF THE INVENTION

1. Field of the Invention

The present invention relates to display arrangements in general, and more particularly to a collapsible and erectable display stand that includes a reinforced object-supporting shelf.

2. Description of the Related Art

There are already known various constructions of collapsible and erectable display stands, among them such that are equipped with shelves for supporting various objects on display at various elevations from the ground. Examples of display stands of this kind can be found, for instance, in U.S. Pat. Nos. 4,493,424, 4,570,805, 4,723,664, and Re. 32,668. A perennial problem identified in conjunction with such display stands is the integrity of the shelves, that is, their ability to support the weight of the objects placed thereon without sagging, buckling or otherwise deforming beyond acceptable limits. While attempts have been made to address this problem, for instance in the manner disclosed in the aforementioned U.S. Pat. No. 4,723,664 where the shelf rests on the upper edge of a vertical partitioning wall (with all directions referred to herein relating to the orientation of the stand while in use), they may have somewhat alleviated it but never actually solved it, especially because their action affected only a relatively small area of the shelf, such as its middle in the case of the stand disclosed in the last-mentioned patent.

On the other hand, it is also known to display magazines and similar items on newsstands or the like in such a manner as to entice a prospective buyer to purchase the same. This usually involves maintaining the magazines in their upright positions, usually with the upper side of the magazine on top, and leaving a significant part of the front page of the magazine unobstructed. Such magazine racks, be they rather unsightly wire structures or shelves, are usually constituted by permanent structures that are relatively bulky and expensive and do not possess the flexibility that is required to take into account the changing availability of the various magazines or issues with time, especially when space availability is limited or the available space is at a premium, as is often the case under these circumstances. Also, the handling of the magazines or the like by the store operator or the purchasing public leaves much to be desired, be it as far as its ease is concerned, or with respect to the secure retention of such items.

OBJECTS OF THE INVENTION

Accordingly, it is a general object of the present invention to avoid the disadvantages of the prior art.

More particularly, it is an object of the present invention to provide an erectable display rack which does not possess the drawbacks of the known display racks of this type.

Still another object of the present invention is to devise a display rack of the type here under consideration which includes a shelf capable of withstanding the forces applied thereto by the objects on display with only minimum deformation despite consisting of a flexible material.

It is yet another object of the present invention to design the above display stand in such a manner as to safely retain the objects on the shelf without, however, obscuring more than an insignificant portion of the front side of the front object.

A concomitant object of the present invention is so to construct the erectable display stand of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an erectable display stand which includes as its main components a generally planar back panel; a generally planar shelf for supporting objects; and at least one generally planar supporting wall. According to the present invention, there is provided means for connecting the shelf and the supporting wall to the back panel for movement relative thereto between their collapsed positions in which they extend in substantial parallelism with one another and with the back panel in close proximity of the latter, and an erected position in which the shelf and the supporting wall extend substantially normal to the back panel and parallel to each other in large-area surface-to-surface contact with one another for the supporting wall to support the shelf from below when the stand is in use.

A particular advantage of the display stand as described so far is that the supporting wall, owing to its large-area surface-to-surface contact with the shelf, effectively doubles the strength of the shelf, that is, its ability to support the objects on display without unduly sagging, in that it is effective all over the shelf rather than at only a small portion thereof.

According to another feature of the present invention, the display stand further includes means for urging the shelf and the supporting wall toward the erected positions thereof. Advantageously, such urging means includes at least one resilient endless element trained about the shelf and the supporting wall. The urging means advantageously presses the supporting wall against the shelf in their erected positions. This has the advantage that the resilient urging means not only is instrumental in promoting automatic conversion of the display stand from its collapsed condition to its erected conditions once freed to do so, but also increases the stability and strength of the shelf/supporting wall combination by giving them a much more unitary structure.

The display stand of the present invention may further include two side walls each hinged to one side of the back panel for movement between its collapsed position in which it is located adjacent the back panel and its erected position in which it extends substantially normal to the back panel to a respective side of the shelf and the supporting wall assuming their erected positions. Then, there may further be provided a front wall interconnecting the side walls, and each of the side walls may then be foldable into its collapsed condition along a crease line substantially parallel to the back panel. Under these circumstances, the connecting means advantageously includes respective hinge regions connecting the shelf to the back panel and the supporting wall to the front wall for pivoting about axes that extend substantially parallel to one another and substantially normal to the side walls. This results in an especially sturdy and compact construction of the display stand and in secure retention of the articles on display in the stand.

According to yet another aspect of the invention, the supporting wall includes an integral extension projecting rearwardly beyond the shelf in its erected positions to provide ground contact at a predetermined distance behind the stand when in use. This measure in effect transfers the location at which the center of gravity of the items on display may be located without backwardly toppling the stand in the rearward direction, making it possible to give the rest of the stand a slight backward slant that causes the magazines to preferentially lean against the back panel, rather than falling forward. To achieve this effect, the side walls are provided with respective extensions that have slanted bottom surfaces to impart the requisite rearward tilt to the stand, the extent of such tilt being actually delimited by the contact of the extension of the supporting wall with ground.

In the alternative, the display stand includes an additional supporting wall similar to the one supporting wall, and the connecting means includes respective hinging portions each connecting one of the supporting walls to one of the side walls for pivoting between the collapsed and erected positions about an axis traversing the respective side wall at a bottom region thereof as considered when the stand is in use. It is particularly advantageous when the supporting walls complement one another in their erected positions.

In accordance with a further aspect of the invention, the display stand further includes an extension panel secured to said back panel and forming its upward continuation when in an extended position that the extension panel assumes when the stand is in use. The extension panel is advantageously secured to the back panel for movement relative thereto between its extended position and a collapsed position is which it is situated adjacent the back panel. It is currently contemplated for the extension panel to carry information that is visible to observers when the stand is in use and the extension panel is in its extended position. Such information is characteristic of the objects on display.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 8 is a perspective elevational view of a further modification of the display stand of the prevent invention in its collapsed condition, as viewed from the rear;

FIG. 9 is a partial front perspective view of the display stand modification of FIG. 8;

DETAILED DESCRIPTION OF THE PREFERRED EMBODIMENTS

Figure 1:
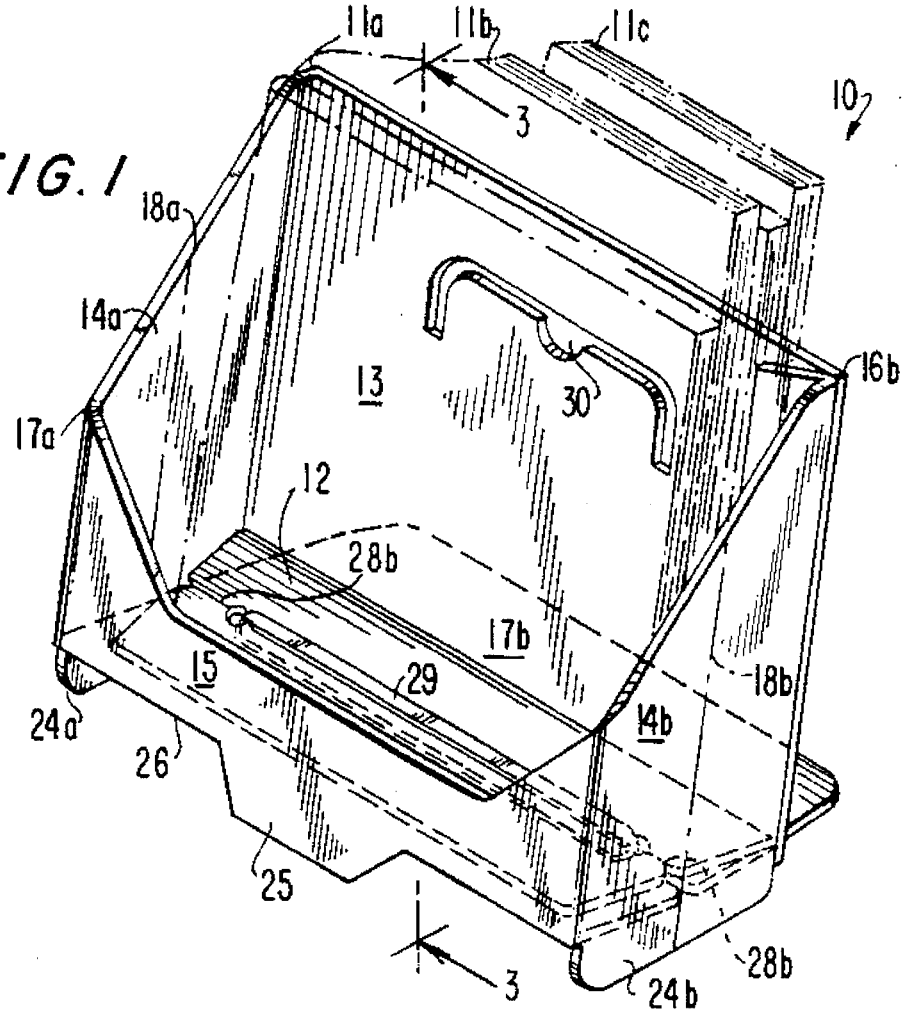
FIG. 1 is a perspective view of a display stand according to the present invention in its erected condition and position of use, taken from the front.

Referring now to the drawing in detail, and first to FIG. 1 thereof, it may be seen that the reference numeral 10 has been used therein to identify an erectable display stand of the present invention in its entirety. The display stand 10 is illustrated as being constructed and configured for displaying magazines or similar articles 11*a*, 11*b*, etc. of the same kind (such as the same issue) in an upright position such that each such article 11*a*, 11*b*, etc. is securely maintained in position regardless of the number of such articles 11*a*, 11*b*, etc. that may be confined in the display stand 10 at any particular time, and yet a substantial portion of the front cover or front page of the first article such as 11*b*, is exposed to view to attract the attention of a potential customer, while the individual items 11*a*, 11*b*, etc. can be easily gripped one after another, not necessarily in order, for withdrawal from the stand 10 in the process of purchasing the same.

To be able to perform its confining function, the stand 10 includes, in addition to a support shelf 12 on which the articles 11*a*, 11*b*, etc. stand, and a back panel 13 against which they lean, two side walls 14*a* and 14*b* that are spaced apart by a distance only slightly exceeding the corresponding dimension of the articles 11*a*, 11*b*, etc. to minimize side-to-side shifting of the articles 11*a*, 11*b*, etc. in the stand 10, and a front wall 15 that prevents the bottom portions of the articles 11*a*, 11*b*, etc. from sliding out of the display stand 10. The walls or panels 13, 14*a*, 14*b* and 15 are hingedly connected with one another at respective hinge regions 16*a*, 16*b*, 17*a* and 17*b*, so that they are able to conduct pivoting or tilting movements relative to one another as the condition of the display stand 10 changes from collapsed to erected or vice versa. In addition, the side walls 14*a* and 14*b* are provided substantially centrally thereof with respective weakened portions or crease lines 18*a* and 18*b* extending substantially parallel to the hinge regions 16*a*, 16*b*, 17*a* and 17*b*. While the two sections into which the respective crease line 18*a* or 18*b* subdivides the associated side wall 14*a* or 14*b* are substantially coplanar in the erected state of the stand 10 as shown in FIG. 1, it is indicated in broken lines in FIG. 2 of the drawing that they are capable of bulging, as shown outwardly, at the respective crease lines 18*a* or 18*b* until they become substantially parallel and coextensive and abut one another in the collapsed condition of the stand 10, while the front and rear walls 15 and 13 are similarly positioned relative to one another and are substantially coplanar with the respective adjacent sections of the side walls 14*a* and 14*b*.

Figure 3:
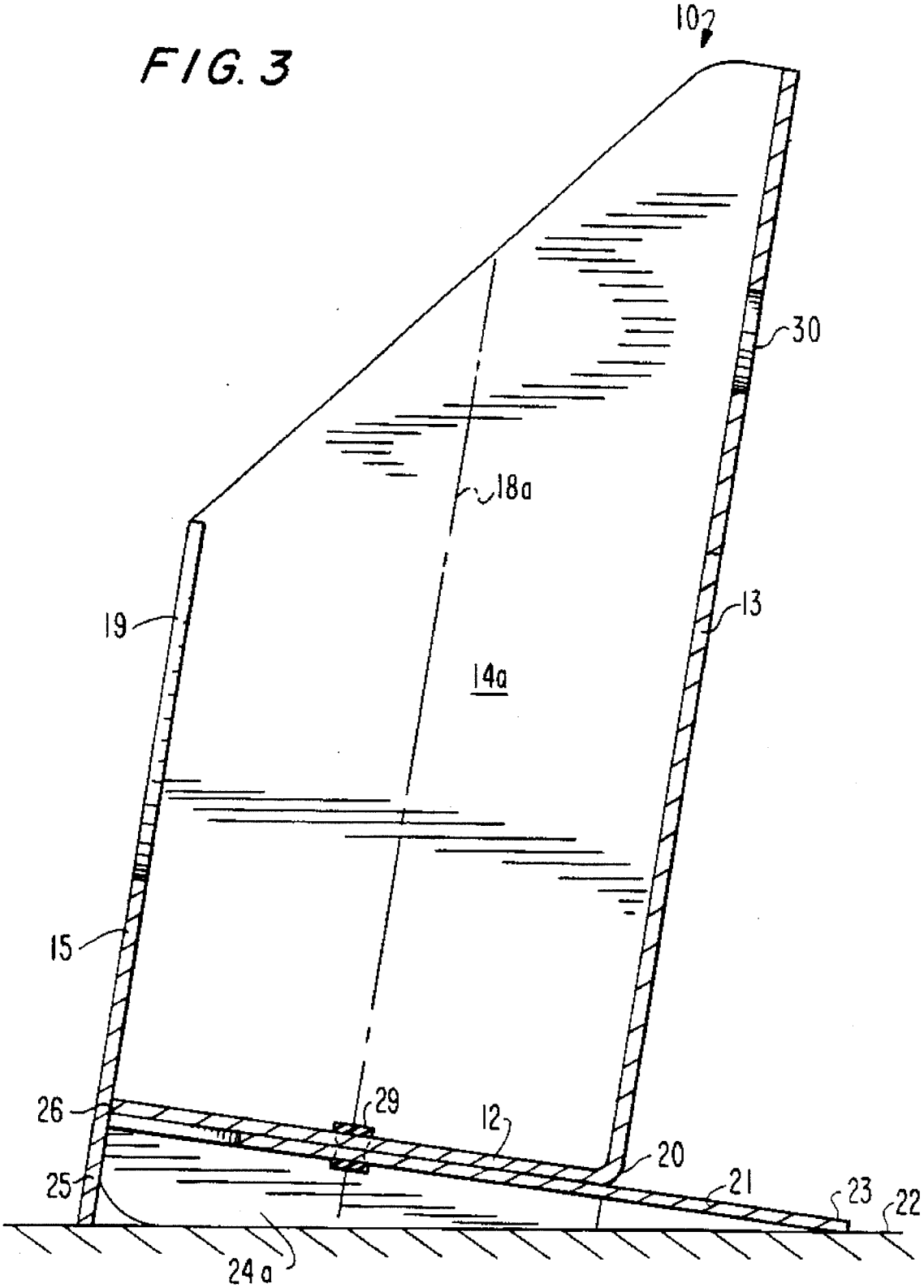
FIG. 3 is a sectional view taken on line 3—3 of FIG. 1.

As a comparison of FIGS. 1 and 3 will reveal, the front wall 15 has a much lower height than the rear panel 13. Moreover, the front wall 15 is provided with a cutout 19 that exhibits a generally inverted trapezoidal shape which further reduces the effective height of the front wall 15 except at the bottom corner regions of the articles 11*a*, 11*b*, etc. It will be appreciated that the thus configured front wall 15 safely retains the articles 11*a*, 11*b*, etc. in the stand 10, without obscuring the front cover or side thereof more than necessary; as a matter of fact, the degree of obscuration in the illustrated stand 10 is so small and affects such regions of the front one of the articles 11*a*, 11*b*, etc. that it is not disturbing or disruptive and in fact is hardly noticeable.

As visible especially in FIG. 3 of the drawing, the bottom wall or flap 12 of the display stand 10 is integral (of one piece) with the back panel 13, being connected to the latter for pivoting with respect thereto about another hinge portion 20 unitary therewith so that the bottom flap can be folded, upwardly in this instance, as the stand 10 is being collapsed, so as to be confined between the front and back walls or panels 15 and 13 in the collapsed condition of the stand 10.

It is also shown especially in FIG. 3 that another, supporting flap 21 is situated underneath the bottom flap 12, supporting the latter from below generally over its entire bottom surface. Yet, the supporting flap 21 is not coterminous or coextensive with the bottom flap 12; rather, it extends to a significant extent rearwardly beyond the latter. As a consequence, the supporting flap 21 effectively transfers the region of contact of the display stand bottom, which is constituted by the flaps 12 and 21, with the ground 22 in the erected condition of use of the stand 10 from that of the hinge portion 20 where it would have been in the absence of the supporting flap 21, to that of a rear marginal portion 23 of the supporting flap 21. This renders it possible to take certain additional measures aimed at imparting a desired rearward tilt to the display stand 10 when in use. These measures include providing the side walls 14*a* and 14*b* with respective downward extensions 24*a* and 24*b* (see FIG. 1) that gradually diminish in height in the rearward direction. They also include providing the front wall 15 with a further downward extension or central nose 25 (creating a complementary void in the supporting wall 21) that extends downwardly beyond another hinge portion 26, at which the supporting wall 21 is hingedly connected to the front wall 15, to contact the ground 22 substantially in alignment with the slanted bottom surfaces of the lateral extensions 24*a* and 24*b* and with the marginal region 23 of the supporting flap 21. This rearward tilt brings about the advantage that the articles such as 11*a*, 11*b*, etc. will preferentially lean against the back panel 13 (unless deliberately or accidentally flipped forward across their dead centers), rather than relying on a fortuitous happenstance for achieving this effect if the stand 10 were to be vertical. Of course, if the additional measures were taken without transferring to ground contact region backward, the stand 10 would be in a precarious situation and likely to topple backwards with its contents in response to application thereto of even minor forces, such as those which may be imparted when taking the chosen one of the articles 11*a*, 11*b*, etc. out of the stand 10 in a less than highly careful manner.

Figure 2:
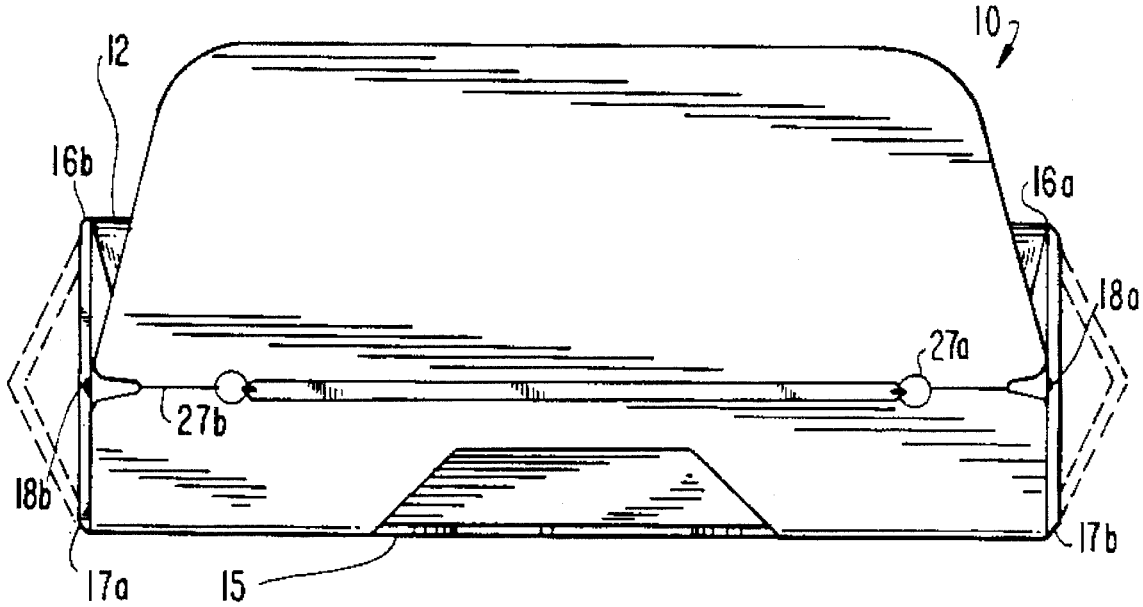
FIG. 2 is a bottom plan view of the display stand of FIG. 1.

When FIGS. 1 and 2 of the drawing are considered in conjunction with one another, it should be evident that both the supporting wall 21 and the bottom wall 12 are provided with respective enlarged-head mutually aligned slits 27*a*, 27*b* and 28*a*, 28*b* that open, via respective enlarged mouths, onto the side edges of the respective walls or flaps 21 and 12, to permit the introduction of an endless resilient element 29, such as a rubber band, into them. It may be seen especially in FIG. 3 that, when the endless element 29 is in place and the stand 10 is in its erected state, it keeps the walls 21 and 12 in abutment with one another. As a matter of fact, the length of the endless element 29 and/or the depths of the slits 27*a*, 27*b*, 28*a* and 28*b* are so chosen or coordinated that the endless element 29 presses the walls 21 and 12 against one another even in the erected condition of the stand 10. This brings about an additional advantage stemming from the provision of the supporting wall 21, namely that the latter effectively doubles the thickness and thus the strength of the bottom wall 12 in the erected condition of the stand 10.

When the stand 10 is to be collapsed, the bottom wall 12 is first pivoted upwardly, as already mentioned before. Simultaneously, the side walls 14*a* and 14*b* are caused to buckle outwardly so that eventually the stand 10 is substantially flat. At this point, the supporting wall 21 can be flipped over about the hinge portion 26, preferably in the back of the back panel 13, thus reducing the size of the collapsed stand 10 to generally correspond to that of the articles 11*a*, 11*b*, etc., so that it can be wrapped with such articles 11*a*, 11*b*, etc. in a common package for transportation to a newsstand or other destination.

It will be appreciated that the collapsing of the stand 10 results in tensioning of the resilient endless element 29, which imparts a pronounced tendency to the stand 10 to automatically move toward its erected state once released from the common package. Thus, the store owner or clerk need not engage in any complex machinations or manipulations to erect the stand 10; rather, it usually will "pop up" by itself, thus presenting itself for the insertion of the articles 11*a*, 11*b*, etc. thereinto immediately upon opening the common package or releasing or removing the wrapping material. The insertion of the articles 11*a*, 11*b*, etc. will in most instances complete the erection process since the action of the weight of the articles 11*a*, 11*b*, etc. on the bottom wall or flap 12 will force that latter into its desired final erected position, if not in it already, thus freeing the other stand components to unimpededly move towards their respective final erected positions.

If so desired, the back panel 13 may be provided, as also shown in FIGS. 1 and 3 of the drawing, at its upper region with a substantially centrally disposed cutout 30 that is configured in such a manner as to enable the user of the stand 10 to form a handle by which to move the stand 10 from one location to another.

Turning now to FIGS. 4 to 7 of the drawing, it is to be mentioned first that they depict a modified display stand construction that is so similar to that discussed above in detail that the same reference numerals are being used to denote the same or corresponding parts, and that such common parts will be discussed hereinbelow only to the extent necessary to understand the differences between these two constructions.

Figures 4, 6:
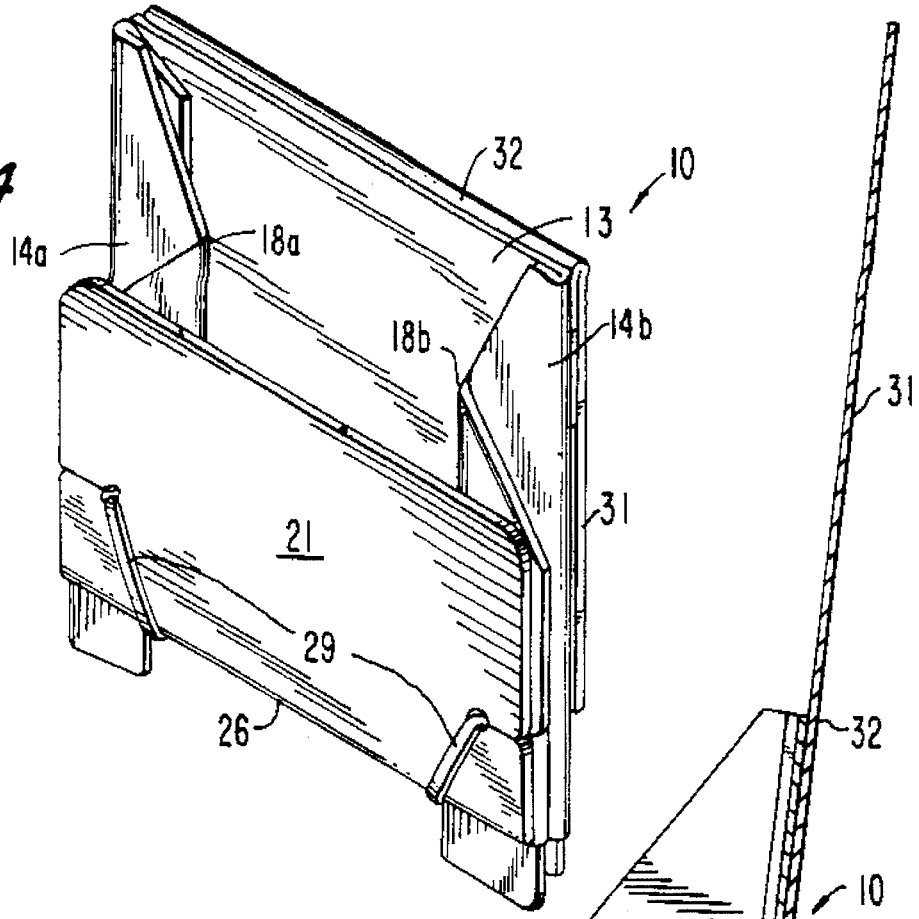
FIG. 4 is a front perspective view of a somewhat modified construction of the display stand of the present invention in its collapsed condition.
FIG. 6 is a sectional view taken on line 6—6 of FIG. 5.
Figure 5:
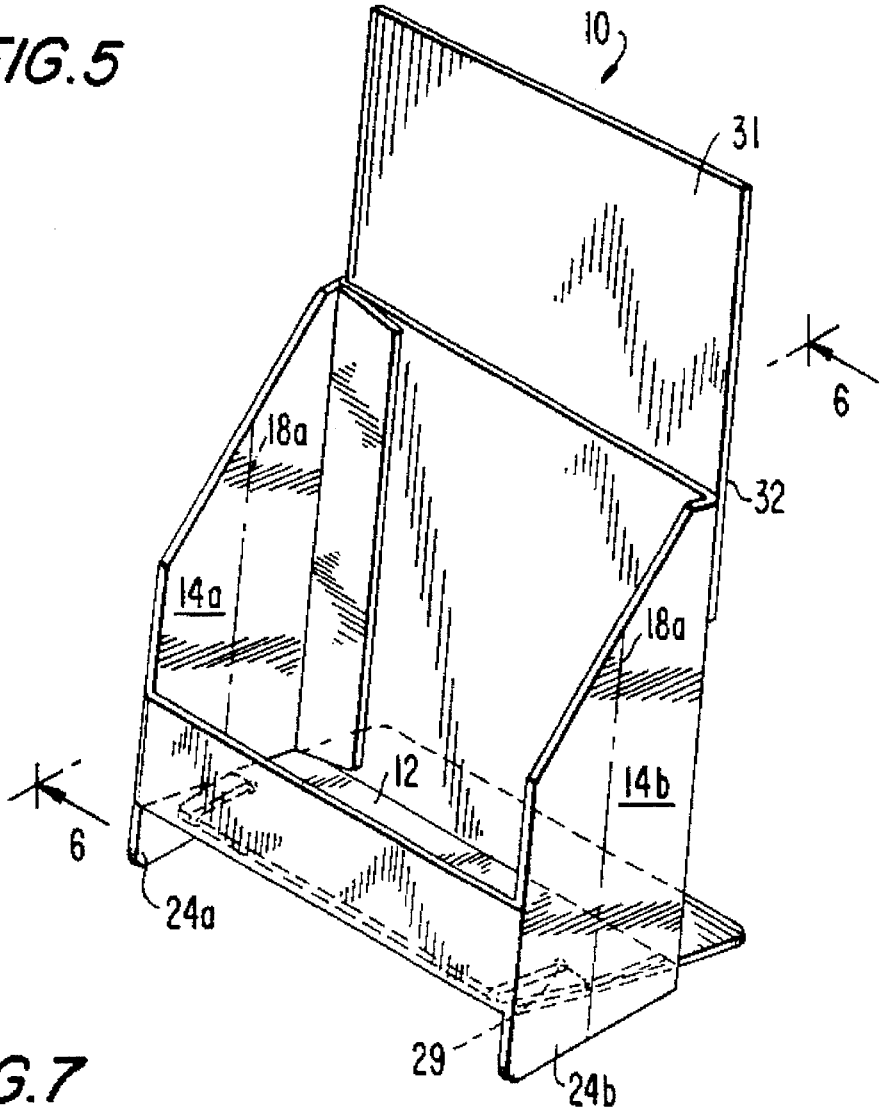
FIG. 5 is a view akin to that of FIG. 1 but showing the modified construction depicted in FIG. 4 in its erected condition.
Figure 7:
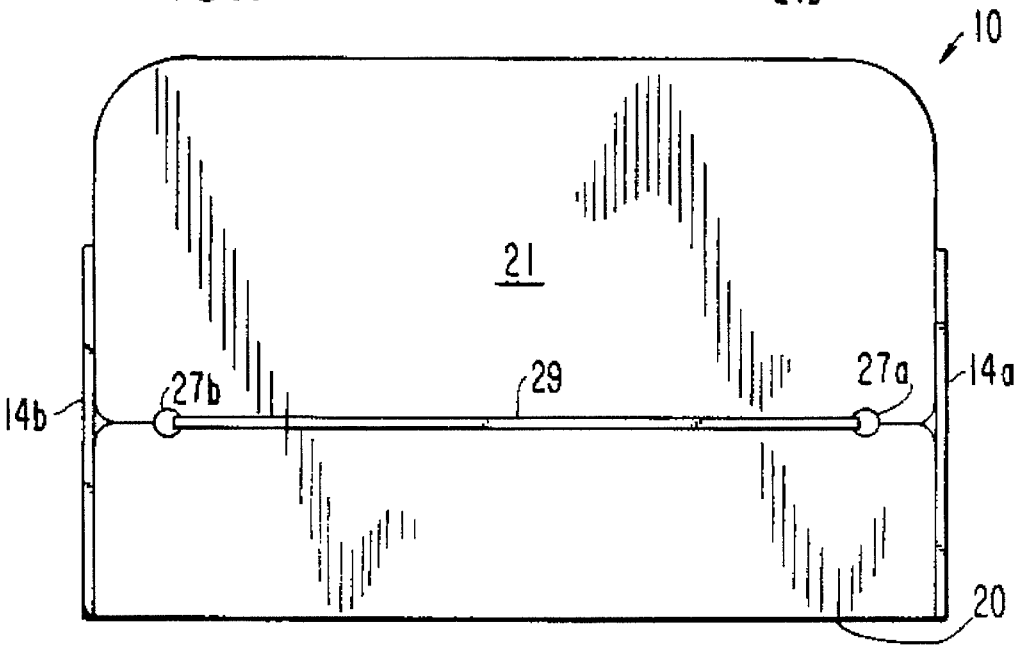
FIG. 7 is bottom plan view of the display stand of FIG. 5.

As may be observed in FIG. 4, in the collapsed condition of this construction of the display stand 10, the side walls 14*a* and 14*b* are folded inwardly about the respective crease lines 18*a* and 18*b* and the supporting wall 21 is located in the front of the back panel 13, of the folded side walls 14*a* and 14*b*, and of necessity, even though not visible in FIG. 4, of the front wall 15 as well. What is also not visible in FIG. 4 because of being hidden behind the supporting wall 21 is that the bottom wall or flap 12 is disposed between the front and back panels 15 and 13, ordinarily being confined between the folded side walls 14*a* and 14*b* and the back panel 13. As indicated especially in FIG. 5, the endless resilient element 29, such as a rubber band, is trained around the front edges of the bottom wall or flap 12 in this instance. However, as shown in FIG. 7, the endless resilient element 29 traverses the shortest possible distance between the slots 27*a* and 27*b* of the supporting wall 21. Here again, the dement 29 is instrumental in automatic erection of the stand 10, and presses the walls or flaps 12 and 21 against one another in the erected condition of the stand 10.

FIGS. 6 and 7 of the drawing also show that the display stand 10 of this construction may be equipped with an extension panel 31 that extends upwardly beyond the back panel 13 in the erected position but, as may be discerned in FIG. 4, is folded about a folding line 32 to end up fight behind the back panel 13 in the collapsed condition of the display stand 10, thus giving the latter the desired collapsed "footprint" commensurate with that of the articles to be displayed. The extension panel 31 may be provided with advertising or similar material designed to attract the attention of potential buyers.

A further modified display stand construction is revealed in FIGS. 8 to 11 with respect to which the same reference numerals as above will once more be used, to the extent possible, to identify corresponding components, for the same reasons as above. In this case, the side walls 14*a* and 14*b* need not be and are not creased, inasmuch as, during the stand collapsing operation, they can be turned about the respective hinging portions 16*a* and 16*b* into juxtaposition with the back panel 13 and one another without having to be folded in half.

Figure 10:
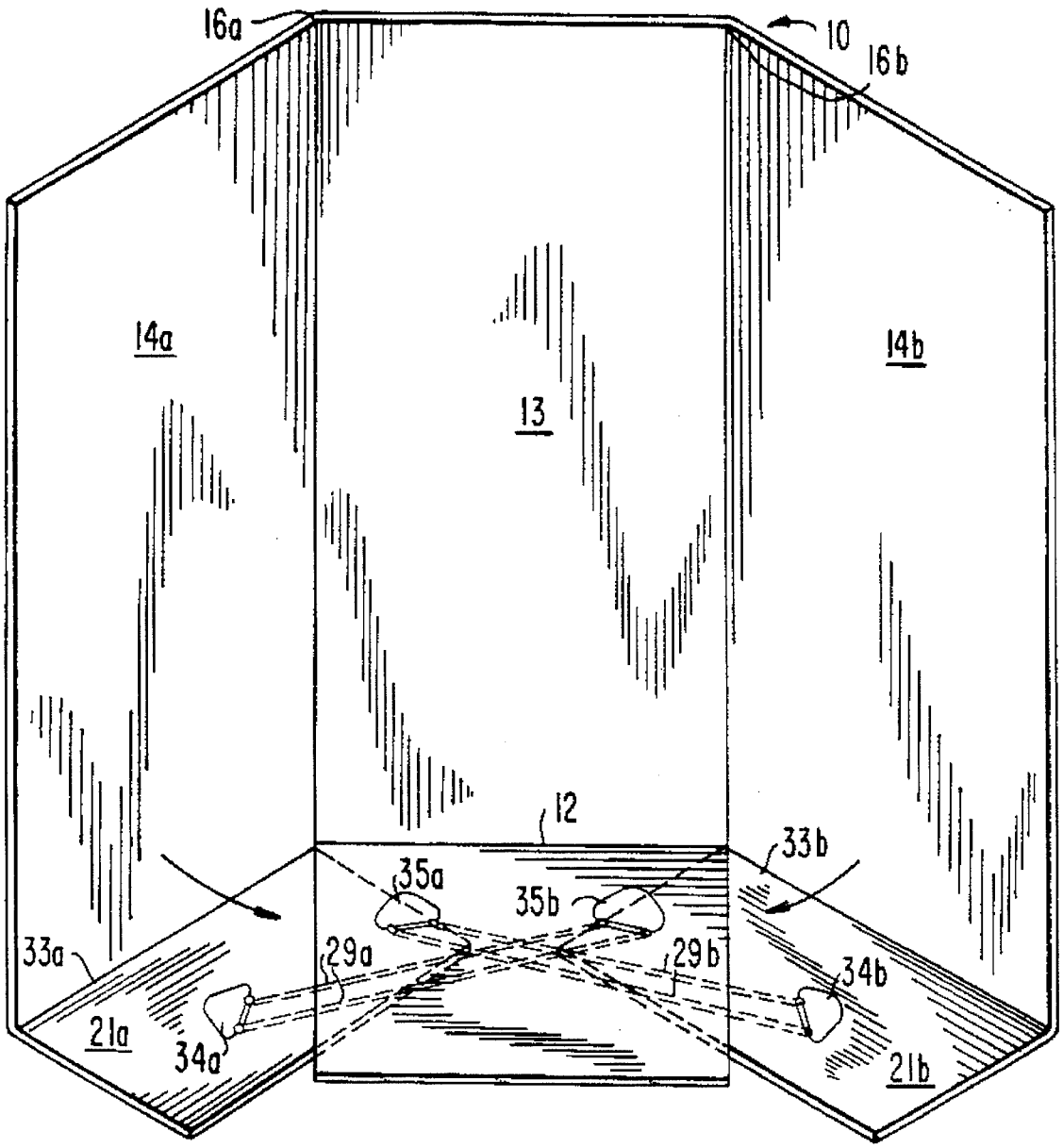
FIG. 10 is a front perspective view of the display stand of FIG. 8 in its partially erected condition.
Figure 11:
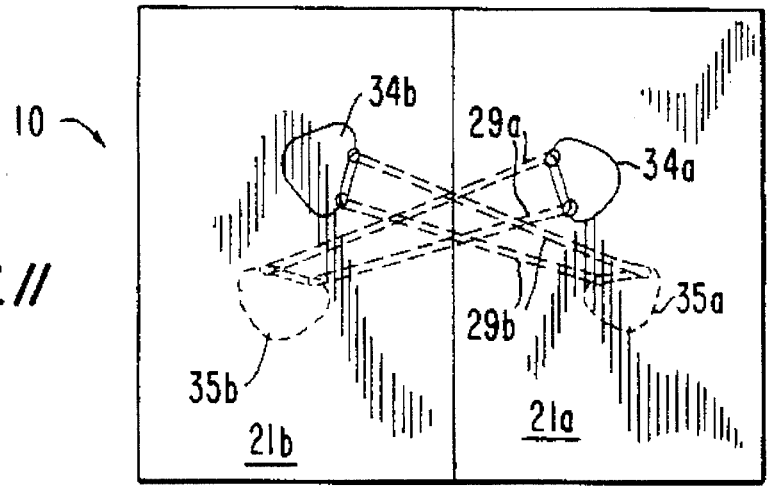
FIG. 11 is a bottom plan view of the display stand of FIGS. 8 to 10 in its fully erected condition.

Referring especially to FIG. 10 of the drawing, it can be observed that the display stand 10 still has a supporting wall structure which, however, is not constituted by a unitary wall 21; rather, it consists of two supporting wall sections 21*a* and 21*b* that are joined to the respective side walls 14*a* and 14*b* by respective fold lines 33*a* and 33*b* permitting them to move between their collapsed positions of FIG. 8 and their erected positions of FIGS. 10 and 11. A plurality of resilient elements 29*a* and 29*b* is being used here instead of the single resilient element 29 described before, these elements 29*a* and 29*b* passing through respective associated openings 34*a* and 34*b* of the supporting wall sections 21*a* and 21*b*, and 35*a* and 35*b* of the bottom wall or shelf 12. It may be seen in FIG. 11 that, in the erected position, the supporting wall sections 21*a* and 21*b* abut one another in the middle of the stand 10.

It will be understood that each of the elements described above, or two or more together, may also find a useful application in other types of constructions differing from the type described above.

While the present invention has been described and illustrated herein as embodied in certain specific constructions of a display stand, it is not limited to the details of these particular constructions, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by Letters Patent is set forth in the appended claims:

1. An erectable display stand, comprising:

a) a generally planar back panel;

b) a generally planar shelf for supporting objects;

c) at least one generally planar supporting wall;

d) means for connecting said shelf and said at least one supporting wall to said back panel for movement relative thereto between collapsed positions thereof in which they extend in substantial parallelism with one another and with said back panel in close proximity of the latter, and an erected position in which said shelf and said at least one supporting wall extend substantially normal to said back panel and parallel to each other in large-area surface-to-surface contact with one another for said supporting wall to support said shelf from below when the stand is in use; and e) means for urging said shelf and said at least one supporting wall toward said erected positions thereof.

2. The display stand as defined in claim 1, wherein said urging means includes at least one resilient endless element trained about said shelf and said at least one supporting wall.

3. The display stand as defined in claim 1, wherein said urging means presses said at least one supporting wall against said shelf in said erected positions thereof.

4. The display stand as defined in claim 1, and further comprising two side walls each hinged to one side of said back panel for movement between a collapsed position in which it is located adjacent said back panel and an erected position in which it extends substantially normal to said back panel to a respective side of said shelf and said at least one supporting wall assuming said erected positions thereof.

5. The display stand as defined in claim 4, and further comprising a front wall interconnecting said side walls; wherein each of said side walls is foldable into its collapsed condition along a crease line substantially parallel to said back panel; and wherein said connecting means includes respective hinge regions connecting said shelf to said back panel and said supporting wall to said front wall for pivoting about axes that extend substantially parallel to one another and substantially normal to said side walls.

6. The display stand as defined in claim 5, wherein said supporting wall includes an integral extension projecting rearwardly beyond said shelf in said erected positions thereof to provide ground contact at a predetermined distance behind the stand when in use.

7. The display stand as defined in claim 5, wherein said side walls have respective extensions that have slanted bottom surfaces to impart a rearward tilt to the stand delimited by said ground contact of said extension of said supporting wall.

8. The display stand as defined in claim 4, and further comprising an additional supporting wall similar to said one supporting wall; and wherein said connecting means includes respective hinging portions each connecting one of said supporting walls to one of said side walls for pivoting between said collapsed and erected positions about an axis traversing the respective side wall at a bottom region thereof as considered when the stand is in use.

9. The display stand as defined in claim 1, and further comprising an extension panel secured to said back panel and forming an upward continuation thereof in an extended position thereof that is assumed when the stand is in use.

10. The display stand as defined in claim 9, wherein said extension panel is secured to said back panel for movement relative thereto between said extended position and a collapsed position is which it is situated adjacent said back panel.

11. The display stand as defined in claim 9, wherein said extension panel carries information that is visible to observers when the stand is in use and said extension panel is in its extended position.

12. The display stand as defined in claim 11, wherein said information is characteristic of the objects on display.

13. An erectable display stand, comprising:

a) a generally planar back panel;

b) a generally planar shelf for supporting objects;

c) at least one generally planar supporting wall, and an additional supporting wall similar to said one supporting wall;

d) two side walls each hinged to one side of said back panel for movement between a collapsed position in which it is located adjacent said back panel, and an erected position in which it extends substantially normal to said back panel to a respective side of said shelf and said at least one supporting wall assuming said erected positions thereof;

e) means for connecting said shelf and said at least one supporting wall to said back panel for movement relative thereto between collapsed positions thereof in which they extend in substantial parallelism with one another and with said back panel in close proximity of the latter, and an erected position in which said shelf and said at least one supporting wall extend substantially normal to said back panel and parallel to each other in large-area surface-to-surface contact with one another for said supporting wall to support said shelf from below when the stand is in use, said connecting means including respective hinging portions each connecting one of said supporting walls to one of said side walls for pivoting between said collapsed and erected positions about an axis traversing the respective side wall at a bottom region thereof as considered when the stand is in use.

14. The display stand as defined in claim 13, and further comprising means for urging said shelf and said at least one supporting wall toward said erected positions thereof.

15. The display stand as defined in claim 13, wherein said one supporting wall and said additional supporting wall complement one another in said erected positions thereof.

* * * * *